US010364122B2

(12) United States Patent
Widsten et al.

(10) Patent No.: US 10,364,122 B2
(45) Date of Patent: Jul. 30, 2019

(54) EJECTING WINDOWED AND NON-WINDOWED MEDIA

(71) Applicant: NCR Corporation, Duluth, GA (US)

(72) Inventors: Benjamin T. Widsten, Kitchener (CA); Husameldin Ibrahim, San Francisco, CA (US); Matthew Gordon Sonnenberg, Kitchener (CA); Yunus Tatar, Milton (CA)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/437,907

(22) Filed: Feb. 21, 2017

(65) Prior Publication Data

US 2018/0237254 A1 Aug. 23, 2018

(51) Int. Cl.

| | |
|---|---|
| ***B65H 43/00*** | (2006.01) |
| ***B65H 43/02*** | (2006.01) |
| ***B65H 83/02*** | (2006.01) |
| ***B65H 7/04*** | (2006.01) |
| ***B65H 31/24*** | (2006.01) |
| ***G07D 11/237*** | (2019.01) |
| *G07D 11/14* | (2019.01) |
| *G07D 11/16* | (2019.01) |

(52) U.S. Cl.

CPC ..... *B65H 43/00* (2013.01); *B65H 7/04* (2013.01); *B65H 31/24* (2013.01); *B65H 43/02* (2013.01); *B65H 83/02* (2013.01); *G07D 11/237* (2019.01); *B65H 2402/45* (2013.01); *B65H 2553/40* (2013.01); *B65H 2701/1912* (2013.01); *G07D 11/14* (2019.01); *G07D 11/16* (2019.01)

(58) Field of Classification Search

CPC ..... B65H 43/00; B65H 2701/1912; G07D 11/0048

See application file for complete search history.

(56) References Cited

U.S. PATENT DOCUMENTS

| | | | | |
|---|---|---|---|---|
| 9,208,630 | B2 | 12/2015 | Fujita et al. | |
| 9,666,035 | B2 | 5/2017 | Blower et al. | |
| 2008/0136657 | A1 | 6/2008 | Clark et al. | |
| 2010/0100230 | A1* | 4/2010 | Babu | G07F 19/20 700/225 |
| 2012/0211328 | A1* | 8/2012 | Ito | G07D 11/0084 194/206 |

FOREIGN PATENT DOCUMENTS

JP 2010 254456 A 11/2010

OTHER PUBLICATIONS

EP Search Report—Jul. 20, 2018.

* cited by examiner

*Primary Examiner* — Michael C McCullough

(74) *Attorney, Agent, or Firm* — Schwegman, Lundberg & Woessner

(57) ABSTRACT

An infeed module of a valuable media depository is configured to track media edge detection during ejection processing. When sensors of the infeed module report conditions that would otherwise indicate that media has exited or been retracted back into the infeed module during ejection processing, reporting of the conditions are delayed or modified based on a tracked edge detection status. Thereby permitting the infeed module to perform proper ejection processing on both windowed and non-windowed media regardless of the dimensions present for any windowed portions of the media.

10 Claims, 8 Drawing Sheets

EJECTING WINDOWED AND NON-WINDOWED MEDIA

BACKGROUND

Media handing devices that process media rely on optical (track) sensors situated throughout the devices for purposes of tracking the media and/or verifying the authenticity of the media. This is particularly relevant for currency notes. Many foreign governments have started printing currency with windowed sections. This is being done to thwart counterfeiters.

Furthermore, governments keep introducing these windowed portions as different sections of the media from what has previously been noted in the industry, which makes accounting for all the different variations and permutations extremely difficult. That is, when a government introduces a middle section of a currency note as being transparent and proper configuration of media handling devices are achieved, the same government or a different government may introduce a currency note where the first section of a currency note is transparent and additional configuration is needed. Another complication is that the consumer can insert currency notes in any orientation meaning upside down, backend first, and the like; such that configurations of the media handling devices have to be configured to handle the various orientations that the consumer may insert a windowed note into the devices.

This presents some challenges for existing optical sensors within existing media devices because the optical sensors fail to detect the presence of the windowed portion of the currency note. When an opaque document is in the path of an optical track sensor, the track sensor reports a blocked condition indicating the presence of media (such as a currency note or a check). When the document passes over and by the optical sensor, the track sensors report an unblocked condition indicating that the track no longer has media above and/or below the track sensors.

With windowed media, when the windowed (transparent) portion of the media is in the path of an optical sensor, the track sensor falsely reports the unblocked condition indicating the absence of any media. These false readings due to portions of a media document being windowed make it difficult for determining whether a windowed portion of a media document has passed over the sensor or whether the entire media document has passed over the sensor, which makes the task of locating and tracking windowed media extremely difficult.

SUMMARY

In various embodiments, methods and a valuable media depository for ejection processing of windowed and non-windowed media within are provided.

According to an embodiment, a method for ejection processing of windowed and non-windowed media is presented. Specifically, media edge detection is selectively ignored from sensors during ejection processing for media being ejected from an infeed module. The media edge detection is enabled during the ejection processing after a shutter opens for the infeed module based on detection of the media from at least one of the sensors. Next, the media is advanced within the infeed module a present distance in a direction towards the shutter during the ejection processing.

DETAILED DESCRIPTION

Figure 1:
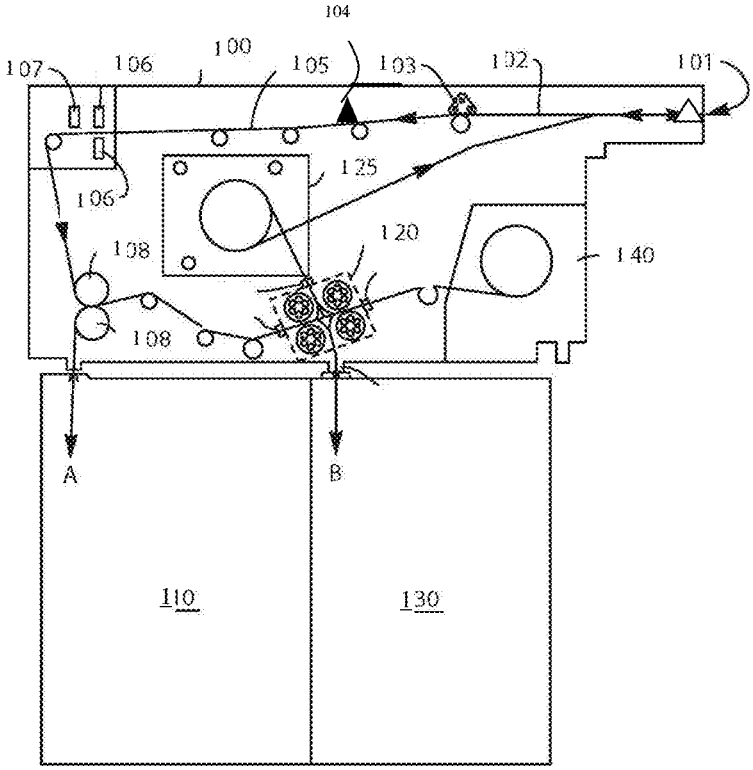
FIG. 1 is a diagram depicting a deposit module of a Self-Service Terminal (SST) having an infeed module, according to an example embodiment.

FIG. 1 is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing adaptive pressure media feeding and processing within the depository 100.

The depository 100 is suitable for use within an Automated Teller Machine (ATM), which can be utilized to process deposited banknotes and checks (valuable media as a mixed bunch if desired). The deposit module 100 has an access mouth (media or document infeed) where a novel configured infeed module 101 (discussed in detail below with reference to the FIGS. 2, 3A-3J, and 4-6) processes and through which incoming checks and/or banknotes (windowed and non-windowed) are deposited or outgoing checks and/or banknotes are dispensed. This mouth is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth in a substantially horizontal direction from right to left shown in the FIG. 1A. They then pass through a separator module 103 and from the separator 103 to a deskew module 104 along another pathway portion 105, which is also substantially horizontal and right to left. The items are now de-skewed and aligned for reading by imaging cameras 106 and a Magnetic Ink Character Recognition (MICR) reader 107.

Items are then directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1), or during another mode of operation, the rollers can be rotated in an opposite fashion to direct processed checks and/or banknotes downwards in the direction shown by arrow A in the FIG. 1 into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1) into a re-buncher unit 125, or downwards in the direction of arrow B in the FIG. 1 into a cash bin 130, or to the right hand side shown in the FIG. 1 into an escrow 140. Items of media from the escrow 140 can selectively be removed from the drum and re-processed after temporary storage. This results in items of media moving from the escrow 140 towards the left hand side of the FIG. 1 where again they will enter the diverter mechanism 120. The diverter mechanism 120 can be utilized to allow the transported checks (a type of valuable media/document) and/or banknotes (another type of valuable media/document) to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1-2, 3A-3J, and 4-6, "valuable media" is referred to as currency and the "valuable media depository" is referred to as a "depository." Additionally, valuable media may be referred to as a "document" herein.

Figure 2:
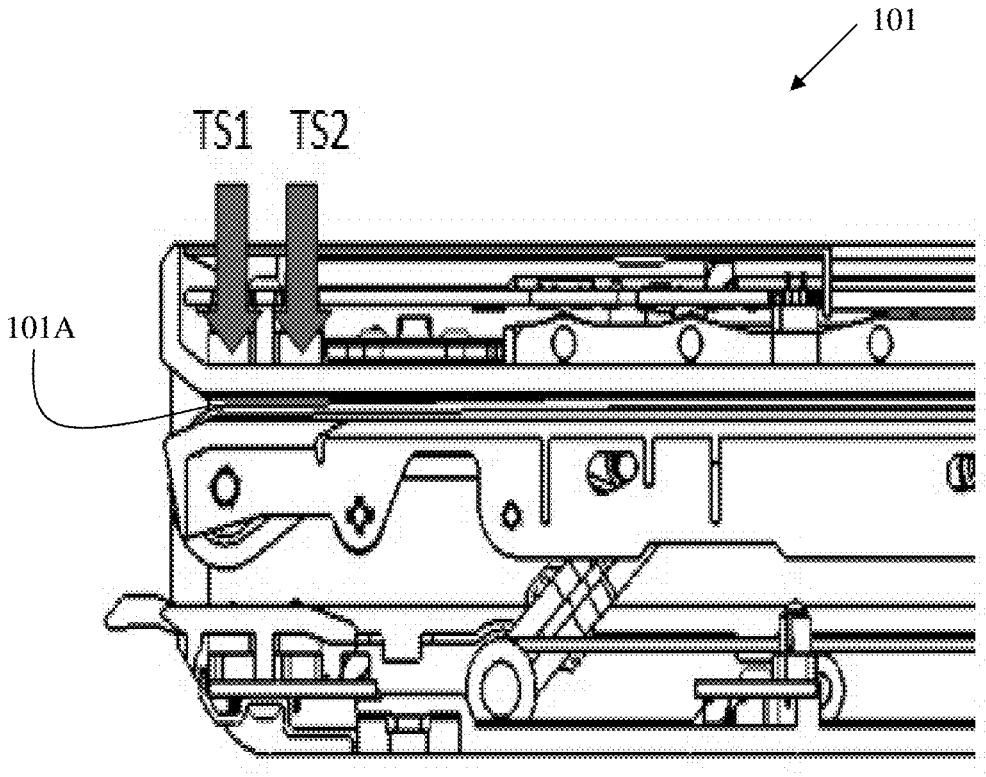
FIG. 2 is a diagram depicting an infeed module, according to an example embodiment.

FIG. 2 is a diagram depicting an infeed module 101, according to an example embodiment.

The infeed mouth 101A is the opening and path within the valuable media depository 100 for an incoming document. A pair of track sensors are labeled as TS1 and TS2 (also labeled as such in the FIGS. 3A-3J below).

Typically, the infeed module 101 is configured for processing a debounce algorithm that is applied to those sensors TS1 and/or TS2 reporting an unblocked condition (no presence of media under the sensors TS1 and/or TS2). When a maximum window size for a document (media) and a speed of the document along the infeed path for the infeed module 101 are known, an algorithm is processed for the sensors TS1 and TS2 reporting for ensuring a sensor TS1 or TS2 is unblocked sufficiently long enough (configured within the algorithm) for the windowed portion (transparent portion) to pass before the sensor TS1 or TS2 reports an unblocked condition. This ensures the unblocked condition reading correctly indicates the absence of media. This approach works when the maximum window (transparency) size and the document throughput processing are known.

While ejecting media to the customer, the media is presented using a programmable "present distance" (the distance the media is positioned and held away from the shutter) and completely stopped over the sensors TS1 and TS2. The infeed module 101 waits a programmable "present delay" period while waiting for the customer to take the media from the infeed mouth. The customer can influence the document speed and direction at any time during the processing, since the document speed is unknown because of this situation, the traditional debounce algorithm has limited assistance in this scenario.

For non-windowed media, the ejection procedure combined with processing of the debounce algorithm works with some windowed media. The non-windowed ejection procedure is as follows:

1) drive media until the TS1 is blocked and then open the infeed mouth shutter;

2) drive the media out the present distance, then stop and hold the media; and 3) delay for the present delay, while waiting for the customer to take the media:

(a) if the TS1 and TS2 report an unblocked condition; the media has been taken, so return to step 1) until no more media is found for ejection processing; or (b) if the TS1 and TS2 stay blocked for the entire present delay, the media has not been taken; the media is retracted by driving the media back into the infeed module 101 until TS1 and TS2 indicate an unblocked condition; then, return to step 1 for re-presenting the media to the customer.

Windowed media is dimensioned, such that when the media was presented and stopped, an opaque portion of the document appears over TS1 and/or TS2. The track sensors report a block condition indicating the presence of the media. Therefore, relying on TS1 and TS2 to report an unblocked condition gives a correct indication of media being removed by the customer.

However, recently new dimensioned windowed media has been introduced by some governments with larger windows and dimensions such that when the media is presented, a windowed portion of the document may be over both TS1 and TS2. The track sensors (TS1 and TS2) falsely report an unblocked condition falsely indicating the absence of media and giving a false indication that the customer has removed the media. This causes the ejection procedure to instantly move from step 3(a) back to step 1), which ultimately ejects the media directly out of the infeed mouth 101A and onto the floor. The customer has no chance to take the media before it is ejected. This results in unacceptable and undesirable behaviors and delivers a poor customer experience.

If the presented media is oriented such that a windowed portion of the document is not over TS1 and TS2, the sensors report a blocked condition correctly indicating the presence of the media (document). If the customer does not take the media within the present delay period, the media is retracted back into the infeed module 101 to then be re-presented. During the retract process, larger windowed sized media will unblock TS1 and TS2 causing a false indication of the absence of media and indicating to the infeed module 101 that the media has been fully retracted into the infeed module 101. This results in the retraction processing stopping prematurely with a portion of the media still sitting outside the shutter of the infeed mouth 101A. The media is then presented a set distance from this point, but since the media was not completely retracted, the present distance causes the media to again be undesirably ejected onto the floor.

Embodiments presented herein, process a novel "edge-direction detection" algorithm to the above-mentioned ejection procedure for universally ejecting all transparent windowed (regardless of window size and location) and non-windowed media. This results in a new, modified, and novel ejection procedure.

As will be explained more completely herein and below, the edge-direction detection algorithm tracks the directions of document edges at all times during the ejection procedure. However, the edge-direction detection status is only used at selective times during the ejection procedure and the status is ignored at other times. This allows windows to pass over and/or stop at TS1 and TS2. Even though the track sensors may report an unblocked condition, the edge-direction detection algorithm allows the ejection procedure to correctly determine if the document has been removed or if a window has been passed and the document is still present within the infeed module 101.

Figure 3A:
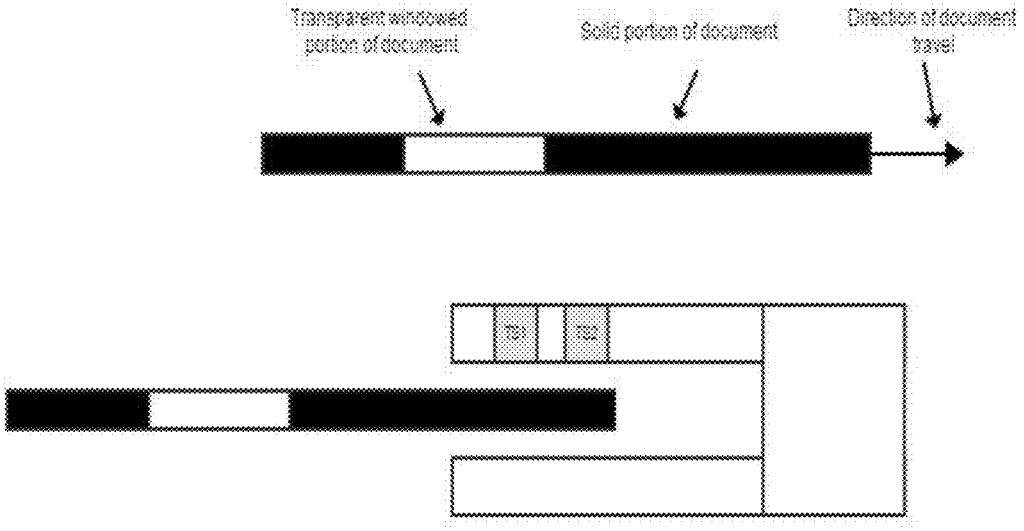
FIGS. 3A-3J illustrate ejection processing scenarios for windowed and non-windowed media performed by the infeed module of the FIG. 2, according to example embodiments.

The novel edge-direction detection algorithm proceeds as follows:

1) If TS1 and TS2 report a block condition, a status becomes "media at TS1 and TS2." Here, media is blocking TS1 and TS2 but the direction of the media is not yet known, this is illustrated in the FIG. 3A.

Figure 3B:
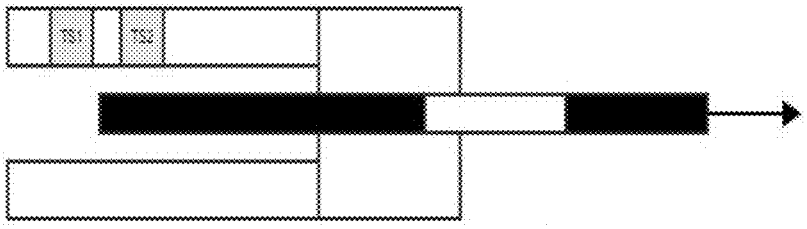
Figure 3C:
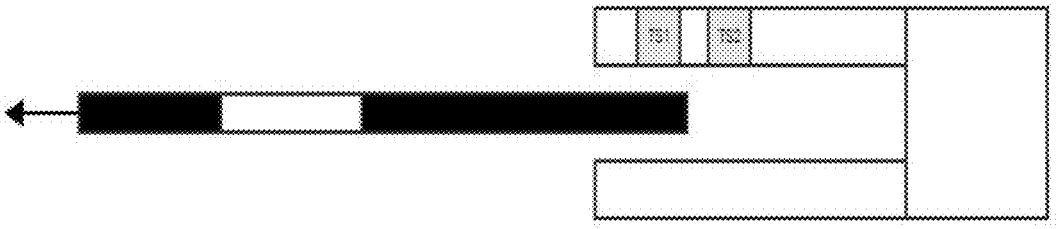

2) If TS1 reports an unblocked condition, the status is changed to "media encountered" as the direction for the media is now known to be inside the infeed module 101, this is shown in the FIG. 3B.

3) Otherwise, if TS2 reports an unblocked condition, the status does not immediately get changed. This is a situation where the direction is known, but the media has not yet completely left the infeed module 101, as shown in the FIG. 3C.

Figure 3D:
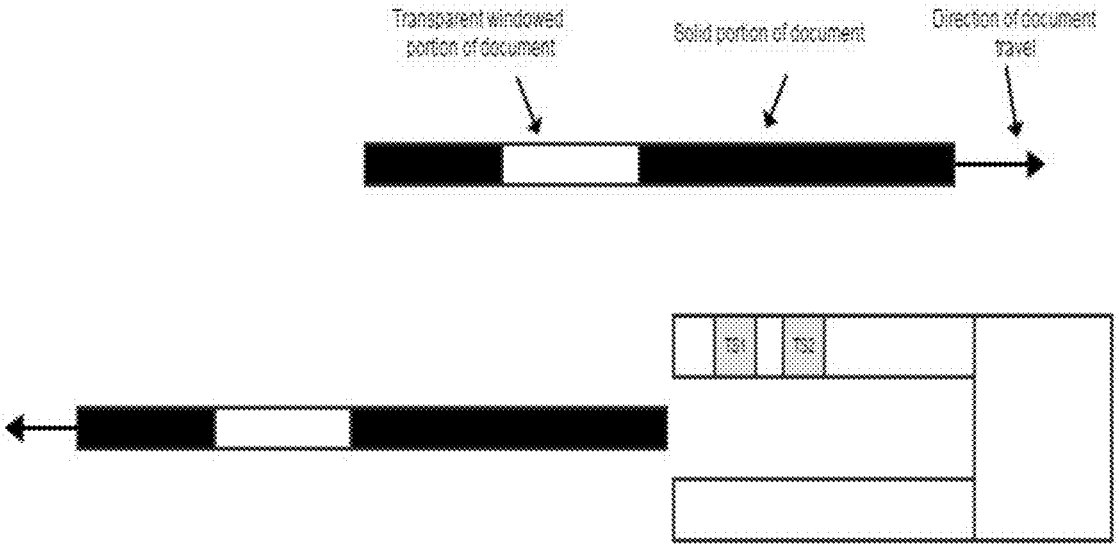

4) If the document (media) continues to travel out the infeed module 101, TS1 reports an unblocked condition and the status is changed to "media exited" since the document is now completely out of the infeed module 101, as shown in the FIG. 3D.

The ejection procedure recited above is further modified for selectively processing the edge-direction detection status and proceeds as follows:

1) Disable the edge-direction detection (the reason for which is discussed below at 4).

Figure 3E:
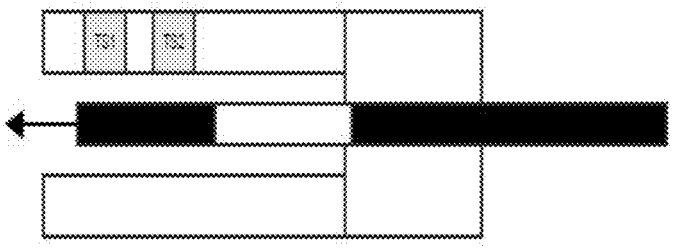

2) Drive the media until TS1 reports a blocked condition, then open the infeed shutter, as shown in the FIG. 3E.

Figure 3F:
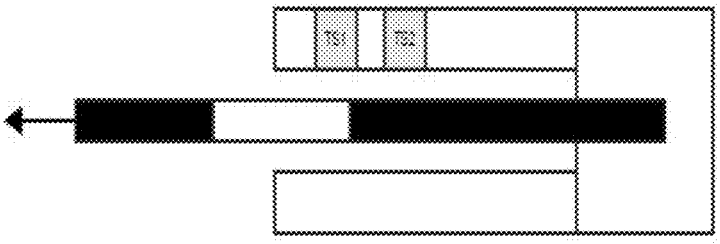
Figure 3G:
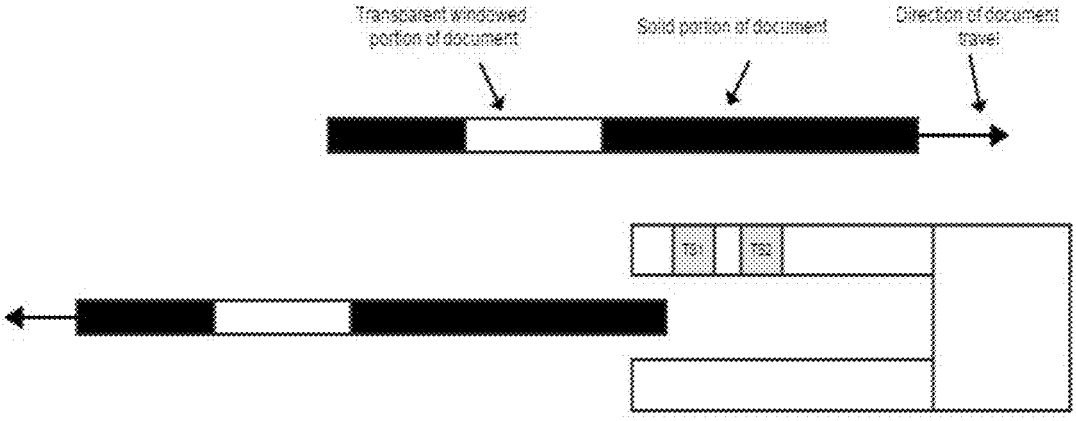
Figure 3H:
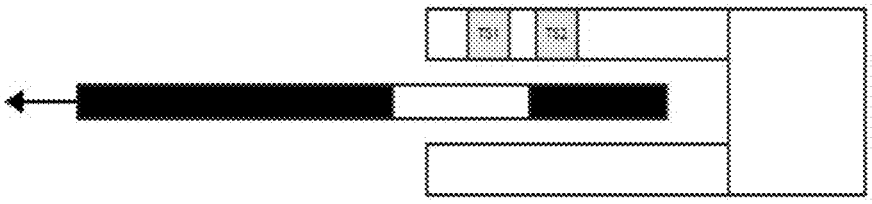
Figure 3I:
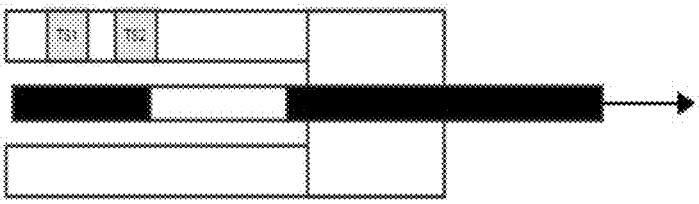

3) Drive the media out the present distance, then stop and hold the media, as shown in the FIG. 3F.

4) Enable edge-direction detection (the reason the edge-direction detection was disabled until now is because between steps 2 and 3 a window could have passed over TS1 and TS2, which could have triggered a status of "media exited" but this is ignored because the edge-direction detection was disabled until here); this allows the windowed media to be properly presented;

5) Delay for the present delay period and wait until the customer takes the media from the infeed mouth 101A; this entails the following processing:

(a) If the edge-direction detection status changes to "media exited," the media may have been taken or a window may have passed so:

a.1) Wait a small delay period to check for a blocking condition reported from either TS1 or TS2. This scenario is depicted in the FIG. 3G. Then, loop back to step 1) until no more media is found for ejection processing.

a.2) If TS1 or TS2 reports a block condition within the present delay period, a windowed portion of the media has passed over TS1 and TS2. This scenario is shown in the FIG. 3H. So, return to 5(a) and resume the present delay.

Figure 3J:
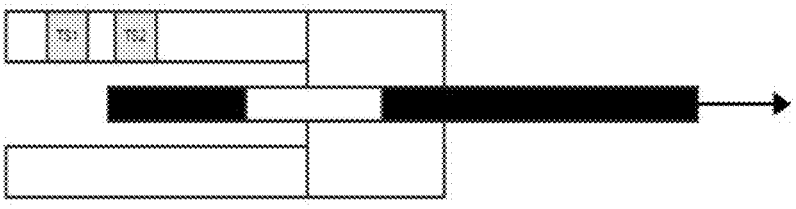

(b) If the edge-direction detection status does not change for the entire present delay period, the media has not been taken from the infeed mouth 101A of the infeed module 101 by the customer so:

b.1) Disable edge-direction detection.

b.2) Drive the media back into the infeed module 101 slightly less than (a configured amount) the present distance. This allows any windows present to pass over TS1 and TS2, as shown in the FIG. 3I.

b.3) Enable edge-direction detection while the media is still being driven back into the infeed module 101 and during 5(b.2), a window could have passed over TS1 and TS2, which could have triggered a "media encountered" status change but was ignored since the edge-direction detection processing was disabled. This allows windowed media to be properly retracted within the infeed module 101.

b.4) Stop driving the media when the edge-direction status changes to "media encountered." This indicates the media has been completely retracted into the infeed module 101 (see the FIG. 3J). Next, go to step 1) for re-presenting the media (re-presentation processing).

The above modified and novel ejection processing for an infeed module 101 allows for windowed and non-windowed media to be presented, retracted, and re-presented with or without TS1 and/or TS2 changing states due to any windowed portions within the media. The processing allows for consistent and correct ejection behavior of the infeed module 101 for both transparent (including any windowed media with larger windowed areas than are presently available today within the industry) and non-windowed media.

Furthermore, a firmware upgrade can provide the novel modified ejection processing so as to enhance existing infeed modules to perform the processing of the infeed module 101 (within a valuable media depository 100) ensuring that the valuable media depository 100 can properly perform ejection processing and media detection on both windowed media and non-windowed media. The novel ejection processing solves the industry problem associated with being unable to properly eject new types of media with larger windows. This single universal processing approach provides accurate and consistent behavior between both windowed and non-windowed media during ejection processing regardless of windowed dimensions. Moreover, there is consistent behavior between both windowed and non-windowed media while providing a familiar "customer feel and experience" regardless of the media type (windowed or non-windowed). This is especially significant for existing customers that are used to non-windowed media but are now starting to use windowed media. This approach also reduces engineering designing, testing, and maintenance complexity. Furthermore, the approach does not necessitate new hardware as it can be implemented with a firmware upgrade to the controller board of the valuable media depository 100 and/or the infeed module 101.

In an embodiment, the infeed module 101 is a peripheral device integrated into the valuable media depository 100.

In an embodiment, the valuable media depository 100 is an SST. In an embodiment, the SST is an ATM. In an embodiment, the SST is a kiosk.

In an embodiment, the valuable media depository 100 is Point-Of-Sale (POS) terminal.

The embodiments discussed above and other embodiments are now discussed with reference to the FIGS. 4-6.

Figure 4:
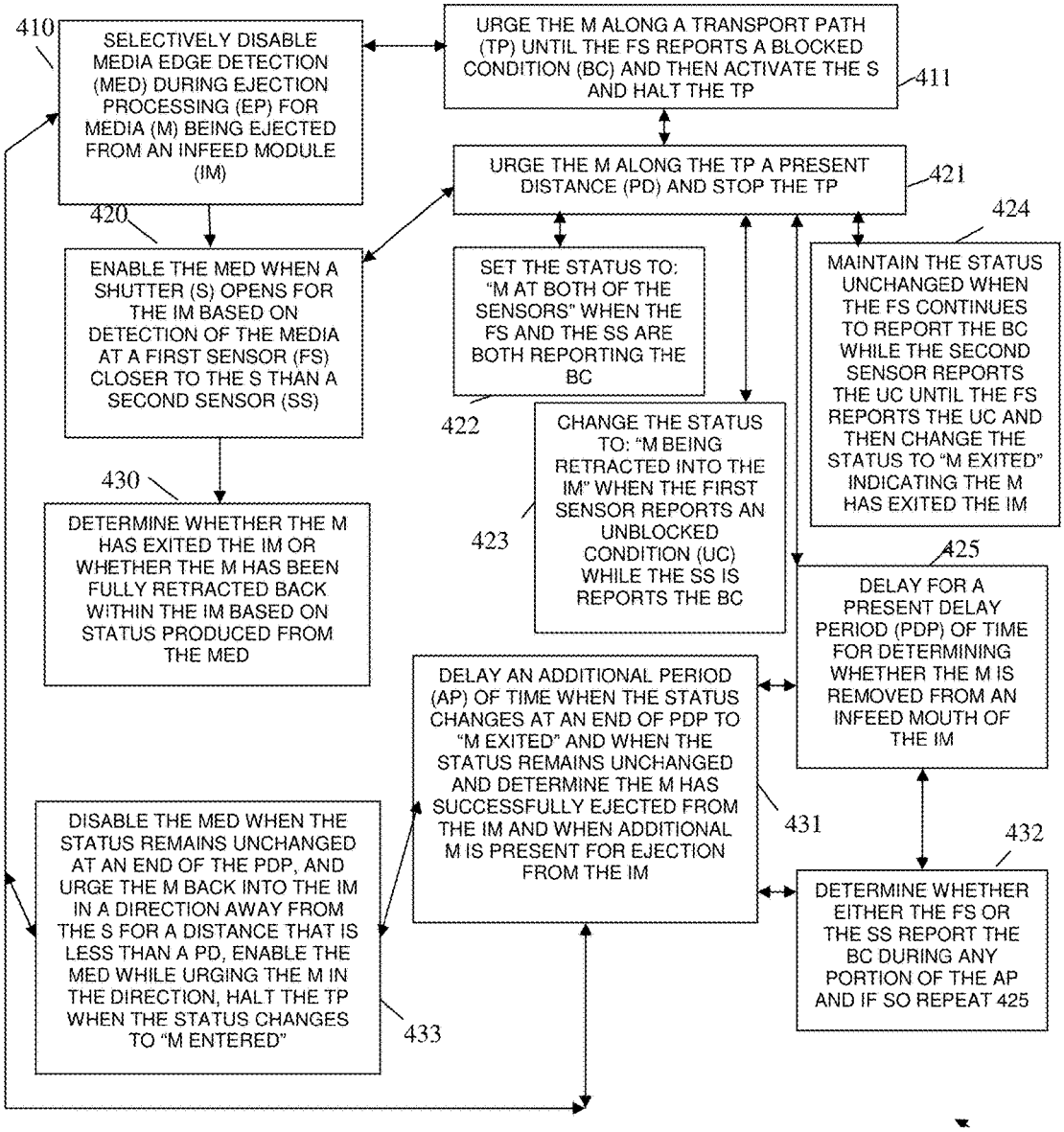
FIG. 4 is a diagram of a method for ejection processing of windowed and non-windowed media performed by an infeed module of a valuable media depository, according to an example embodiment.

FIG. 4 is a diagram of a method 400 for ejection processing of windowed and non-windowed media performed by an infeed module of a valuable media depository, according to an example embodiment. The method 400 when processed controls ejection operations for infeed module integrated into a valuable media depository. The method 200 is implemented as executable instructions representing one or more software modules referred to as a "media ejection controller." The instructions reside in a non-transitory computer-readable medium and are executed by one or more processors of the valuable media depository and/or an infeed module.

In an embodiment, the media ejection controller is executed by one or more processors of the valuable media depository 100.

In an embodiment, the media ejection controller is executed by one or more processors of the infeed module 101.

In an embodiment, the media ejection controller performs the ejection processing discussed above with the FIGS. 2 and 3A-3J.

In an embodiment, the valuable media depository is a deposit module.

In an embodiment, the valuable media depository is a recycler module.

In an embodiment, the valuable media depository is a peripheral device integrated into an SST. In an embodiment, the SST is an ATM. In an embodiment, the SST is a kiosk.

In an embodiment, the valuable media depository is a peripheral device integrated into a Point-Of-Sale (POS) terminal.

At 410, the media ejection controller selectively disables media edge detection processing during ejection processing for media being ejected from an infeed module.

In an embodiment, the media edge detection processing is the edge-direction detection processing discussed above with the FIGS. 2 and 3A-3J. In an embodiment, the ejection processing is the ejection processing discussed above with the FIGS. 2 and 3A-3J.

According to an embodiment, at 411, the media ejection controller urges the media along a transport path until a first sensor closest to a shutter of the infeed module at an infeed mouth reports a blocked condition (indicating that an opaque portion of the media is under the first sensor). In response to this blocked condition from the first sensor, the media ejection controller activates the shutter at the infeed mouth to open the shutter so that the media can be partially pushed out the infeed mouth.

At 420, the media ejection controller enables the media edge detection processing when the shutter opens based on detection by the first sensor (closest to the shutter and closer to the shutter than a second sensor) of the presence of the media at the first sensor. This is shown in the FIG. 3E.

According to an embodiment of 420 and 411, at 421, the media ejection controller urges the media along the transport path a present distance and then stops the transport path preventing any further traveling of the media within the infeed module along the transport path. The present distance is a configured distance based on a size (dimension of the media). At this point the direction of travel of the media may still be unknown and the media may be traveling out the infeed mouth for acquisition by a customer or may be traveling back into the infeed mouth after a failed acquisition by the customer. This is shown in the FIG. 3F.

In an embodiment of 421 and at 422, the media ejection controller sets the status to "media at both of the two sensors" when the first sensor and the second sensor are both reporting a blocked condition (indicating that an opaque portion of the media is under the two sensors). This detected condition is shown above in the FIG. 3A.

In an embodiment of 421 and at 423, the media ejection controller changes the status to "media being retracted into the infeed module" when the first sensor reports an unblocked condition while the second sensor reports the blocked condition. The direction of travel of the media is known to be back within the infeed module for a second attempt to eject the media from the infeed module. This detected condition is shown above in the FIG. 3B.

In an embodiment of 421 and at 424, the media ejection controller maintains the status as unchanged when the first sensor continues reporting the blocked condition while the second sensor reports the unblocked condition until the first sensor reports the unblocked condition. In response to this situation, the media ejection controller changes the status to "media exited" indicating that a customer has obtained the media and pulled it from the infeed mouth of the infeed module. Here, the media direction of travel is resolved to be a direction that is out of the infeed module through the infeed mouth. This detected condition is illustrated in the FIG. 3C.

In an embodiment of 421 and at 425, the media ejection controller delays for a present delay period of time for determining whether the media is successfully removed from the infeed mount of the infeed module by a customer. This detected condition is illustrated in the FIG. 3D.

At 430, the media ejection controller determines whether the media has exited the infeed module or whether the media has been fully retracted back within the infeed module based on status produced from the media edge detection processing.

According to an embodiment of 430 and 425, at 431, the media ejection controller delays for an additional period of time when the status changes at the end of the present delay period of time to "media exited" and when the status remains unchanged the media ejection controller determines that the media has successfully ejected and taken by a customer from the infeed mouth. The media ejection controller determines if additional media is present for ejection and if so, the processing resumes back at 410 to perform ejection processing on the additional media (this continues until all of the media that is to be ejected through the infeed mouth of the infeed module has been successfully ejected). This is shown in the FIG. 3G.

In an embodiment of 431 and 425, at 432, the media ejection controller determines whether either the first sensor or the second sensor report the blocked condition during any portion of the additional period of delay (defined at 431). If this condition is found, then the media ejection controller resumes processing at 425. This is illustrated in the FIG. 3H.

In an embodiment of 431 and at 433, the media ejection controller disables the media edge detection when the status remains unchanged during the present delay period (defined at 425) and, in response to such a condition, the media ejection controller urges the media back into the infeed module in a direction away from the shutter (infeed mouth) for a distance that is less than the present distance. Next, the media ejection controller re-enables the media edge detection processing while the media is being urged in the direction. Then, the media ejection controller, halts travel of the media by halting or stopping the transport path when the status changes to "media entered." This is a failed ejection attempt indicating that the customer did not pull the media out of the infeed mouth; the media ejection controller pulls the media back within the infeed module to try again to eject the media out the infeed mouth, so the processing resumes back at 410. These conditions are illustrated in the FIGS. 3I and 3J.

Figure 5:
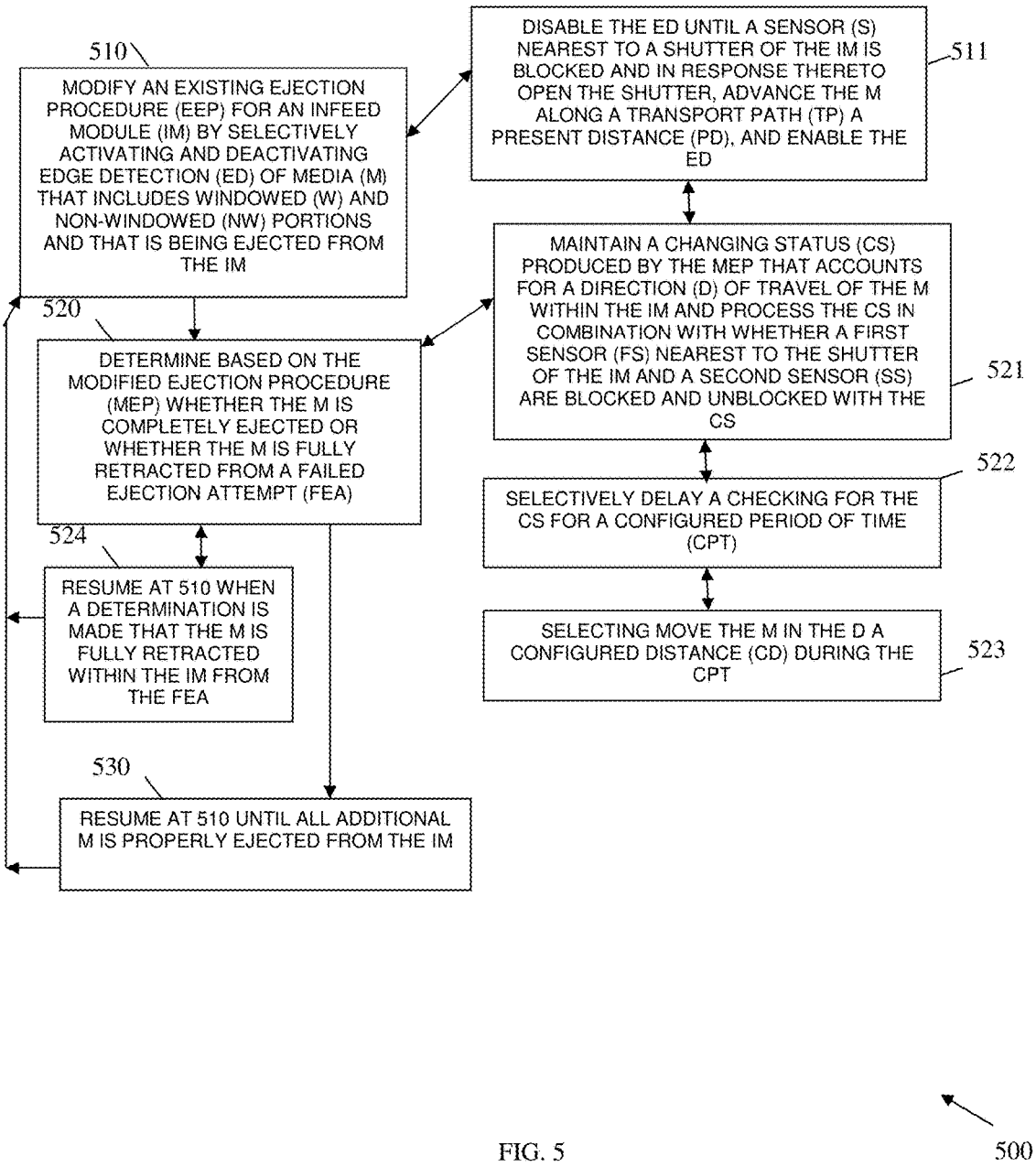
FIG. 5 is a diagram of another method for ejection processing of windowed and non-windowed media performed by an infeed module of a valuable media depository, according to an example embodiment.

FIG. 5 is a diagram of another method 500 for ejection processing of windowed and non-windowed media performed by an infeed module of a valuable media depository, according to an example embodiment. The method 500 when processed controls media ejection processing within a valuable media depository by controlling ejection operations of an infeed module of the valuable media depository. The method 500 is implemented as executed instructions representing one or more software modules referred to as a media ejection manager. The instructions reside in a non-transitory computer-readable medium and are executed by one or more processors of the valuable media depository and/or the infeed module.

In an embodiment, the media ejection manager is executed by one or more processors of the valuable media depository 100.

In an embodiment, the media ejection manager is executed by one or more processors of the infeed module 101.

In an embodiment, the media ejection manager is another perspective of and includes the processing of the media ejection controller of the FIG. 4.

In an embodiment, the media ejection manager performs the ejection processing discussed above with the FIGS. 2 and 3A-3J.

In an embodiment, the valuable media depository is a deposit module.

In an embodiment, the valuable media depository is a recycler module.

In an embodiment, the valuable media depository is a peripheral device integrated into an SST. In an embodiment, the SST is an ATM. In an embodiment, the SST is a kiosk.

In an embodiment, the valuable media depository is a peripheral device integrated into a Point-Of-Sale (POS) terminal.

At 510, the media ejection manager modifies an existing ejection procedure for an infeed module of a valuable media depository by selectively activating and deactivating edge detection (edge-direction detection processing discussed above with the FIGS. 2 and 3A-3J) of media. The media includes at least one windowed portion (transparent portions) and non-windowed portions (opaque portions), and the media is being ejected from the infeed module.

According to an embodiment, at 511, the media ejection manager disables the edge detection until a sensor nearest to a shutter at an infeed mouth of the infeed module is blocked by the media. In response to this condition, the media ejection manager opens the shutter, advances the media along a transport path of the infeed module a present distance, and enables the edge detection processing.

At 520, the media ejection manager determines, based on the modified ejection procedure, whether the media is completely ejected (taken from the infeed mouth by a customer) or whether the media is fully retracted back into the infeed module away from the infeed mouth from a failed ejection attempt (failed because the media was presented through the infeed mouth and the customer failed to remove the media from the infeed mouth).

In an embodiment of 520 and 511, at 521, the media ejection manager maintains a changing status produced by the modified ejection procedure that accounts for a direction of travel of the media within the infeed module (the direction can be towards the infeed mouth or back into the infeed module following the failed ejection attempt). Next, the media ejection manager processes the changing status in combination with whether a first sensor nearest to the shutter and a second sensor (farther from the shutter than the first sensor) are blocked and unblocked as indicated by the changing status.

In an embodiment of 521 and at 522, the media ejection manager selectively delays a checking for the changing status for a configured period of time.

In an embodiment of 522 and at 523, the media ejection manager selectively moves the media in the direction for a configured distance during the configured period of time for the delay.

In an embodiment, at 524, the media ejection manager resumes processing back at 510 when a determination is made that the media is fully retracted back into the infeed module from the failed ejection attempt (the customer did not pull the media out of the infeed mouth of the infeed module).

According to an embodiment, at 530, the media ejection manager resumes processing at 510 until all additional media that is to be ejected has been properly and successfully ejected from the infeed module (successfully taken by the customer from the infeed mouth of the infeed module). In an embodiment, at least one of the additional media includes no windowed portions.

Figure 6:
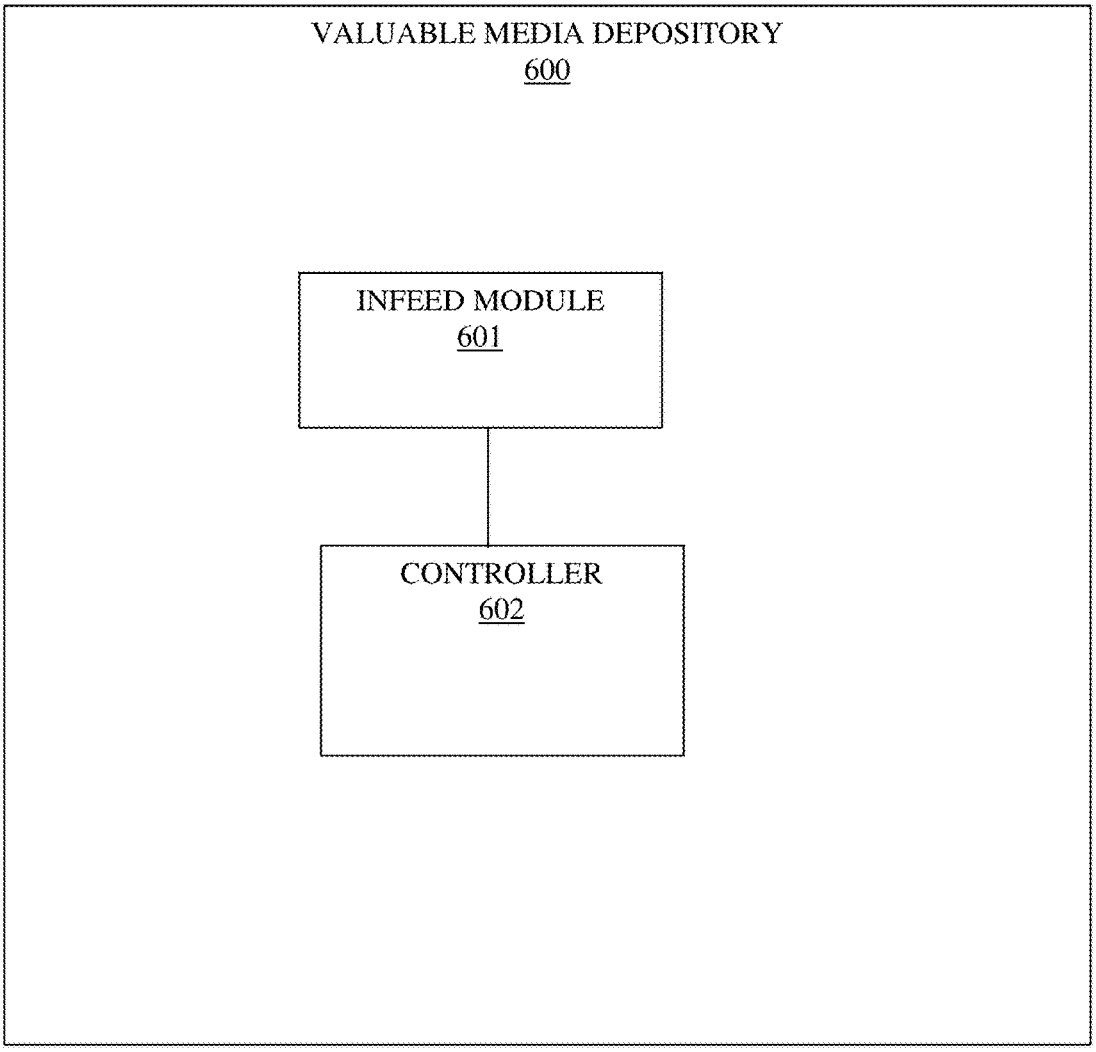
FIG. 6 is a diagram of a valuable media depository, according to an example embodiment.

FIG. 6 is a media depository 600 with an infeed module, according to an example embodiment. The valuable media depository 600 processes valuable media and includes a variety of mechanical, electrical, and software/firmware components, some of which were discussed above with reference to the FIGS. 1-2, 3A-3J, and 4-5.

In an embodiment, the valuable media depository 600 is a deposit module.

In an embodiment, the valuable media depository 600 is a recycler module.

In an embodiment, the valuable media depository 600 is the depository 100.

In an embodiment, the valuable media depository 600 is the depository that performs: any or, some combination of, or all of the processing discussed above in the FIGS. 1-2, 3A-3J, and 4-5.

In an embodiment, the valuable media depository 600 is a peripheral device integrated into an SST. In an embodiment, the SST is an ATM. In an embodiment, the SST is a kiosk.

In an embodiment, the valuable media depository 600 is a peripheral device integrated into a Point-Of-Sale (POS) terminal.

The valuable media depository 600 includes an infeed module 601 including a controller 602 operable to control media ejection processing for the infeed module 601.

In an embodiment, the infeed module 601 is the infeed module 101.

The controller 602 is configured, adapted, and operable to control ejection of both non-windowed media and windowed media (media with at least one transparent or see-through portion).

The controller 602 is further configured, adapted, and operable to selectively enable and disable edge direction detection status processing based on blocked and unblocked conditions reported from at least two track sensors of the infeed module 601 and in response to changing statuses determining when any currently processed media is properly ejected from the infeed module 601 or is properly retracted within the infeed module 601 based on a failed ejection attempt In an embodiment, the edge direction detection status is the edge-direction detection status processing (and resulting status values) discussed above with the FIGS. 2 and 3A-3J.

In an embodiment the controller 602 is one of or some combination of: 1) the processing discussed above with the FIGS. 2 and 3A-3J, the method 400, and/or the method 500.

In an embodiment, the controller 602 drives the electromechanical components of the infeed module 101 as discussed in the FIGS. 2, 3A-3J, and 4-5.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

(i) disabling media edge detection processing during ejection processing by a media ejection controller for media being ejected from an infeed module, wherein the media ejection controller tracks directions of movement of the media based upon signals from first and second sensors during media edge detection;

(ii) enabling the media edge detection processing by the media ejection controller when a shutter opens for the infeed module based on detection of the media at the first sensor, wherein the first sensor is closer to the shutter than the second sensor; and (iii) determining by the media ejection controller whether the media has exited the infeed module or whether the media has been fully retracted back within the infeed module based on signals from the first and second sensors produced during the media edge detection processing.

2. The method of claim 1, wherein (i) further includes activating a media transport to urge the media along a transport path until the first sensor reports a blocked condition and then opening the shutter and halting the media transport by the media ejection controller.

3. The method of claim 2, wherein activating further includes activating the media transport to urge the media along the transport path a present distance and stopping the media transport.

4. The method of claim 3, wherein (ii) further includes (a) setting a media status to: "media at both of the sensors" by the media ejection controller when the first sensor and the second sensor are both reporting the blocked condition, wherein the media status represents a current condition for the media within the infeed module based on current information being reported by the media sensors.

5. The method of claim 4, wherein (ii) further includes (b) changing the media status to: "media being retracted into the infeed module" by the media ejection controller when the first sensor reports an unblocked condition while the second sensor is reporting the blocked condition.

6. The method of claim 5, wherein (ii) further includes (c) maintaining the media status unchanged by the media ejection controller when the first sensor continues to report the blocked condition while the second sensor reports the unblocked condition until the first sensor reports the unblocked condition and then changing by the media ejection controller the media status to "media exited" indicating the media has exited the infeed module.

7. The method of claim 3, wherein activating further includes (iv) delaying for a present delay period of time for determining whether the media is removed from an infeed mouth of the infeed module.

8. The method of claim 7, wherein (iii) further includes delaying an additional period of time by the media ejection controller when a media status is permitted to change at an end of the present delay period to "media exited", and when the media status remains unchanged determining by the media ejection controller that the media has successfully ejected from the infeed module and when additional media is present for ejecting from the infeed module returning to step (i), wherein the media status represents a current condition for the media within the infeed module based on current information being reported by the media sensors.

9. The method of claim 8, wherein (iii) further includes determining by the media ejection controller whether either the first sensor or the second sensor report the blocked condition during any portion of the additional period of time and when determined to be the case returning to step (iv).

10. The method of claim 7, wherein (iii) further includes disabling the media edge detection processing by the media ejection controller when the media status remains unchanged at an end of the present delay period, and activating by the media detection controller the media transport to urge the media back into the infeed module in a direction away from the shutter for a distance that is less than a present distance, enabling by the media ejection controller the media edge detection processing while activating the media transport, halting the media transport by the media ejection controller when the media status changes to "media entered", and returning to step (i).

* * * * *